US006684912B2

(12) United States Patent
Katsura

(10) Patent No.: US 6,684,912 B2
(45) Date of Patent: Feb. 3, 2004

(54) NET BODY USING HELICAL WIRE MEMBERS

(75) Inventor: Nobuhiko Katsura, Omura (JP)

(73) Assignees: Nippon Steel Corporation, Tokyo (JP); Nobohiko Katsura, Nagasaki (JP); Taihei Manufacturing Co., Ltd., Osaka (JP)

( * ) Notice: Subject to any disclaimer, the term of this patent is extended or adjusted under 35 U.S.C. 154(b) by 172 days.

(21) Appl. No.: 10/048,366

(22) PCT Filed: May 21, 2001

(86) PCT No.: PCT/JP01/04230

§ 371 (c)(1),
(2), (4) Date: Jan. 24, 2002

(87) PCT Pub. No.: WO01/90459

PCT Pub. Date: Nov. 29, 2001

(65) Prior Publication Data

US 2002/0107569 A1 Aug. 8, 2002

(30) Foreign Application Priority Data

May 25, 2000 (JP) ..... 2000-153990

(51) Int. Cl.[7] ..... D03D 15/00

(52) U.S. Cl. ..... 139/425 R; 245/5; 245/7; 245/8; 245/9; 245/11; 442/228; 442/229

(58) Field of Search ..... 245/1, 2, 5, 6, 245/7, 8, 9, 11; 139/425 R; 442/6, 228, 229

(56) References Cited

U.S. PATENT DOCUMENTS 2,054,813 A * 9/1936 Gore ..... 245/6
2,123,893 A * 7/1938 Guba ..... 198/820
2,127,358 A * 8/1938 Guba ..... 245/6
2,135,333 A * 11/1938 Guba ..... 245/6
2,147,328 A * 2/1939 Scherfel ..... 245/6
2,223,390 A * 12/1940 Scherfel ..... 245/6
2,255,364 A * 9/1941 Pink ..... 198/848
2,276,099 A * 3/1942 Scherfel ..... 198/820
2,278,860 A * 4/1942 Blackburn ..... 198/820
2,679,368 A * 5/1954 Aigner ..... 245/7
2,903,021 A * 9/1959 Holden et al. ..... 139/425 A
4,575,472 A * 3/1986 Lefferts ..... 428/222
5,334,440 A * 8/1994 Halterbeck et al. ..... 428/222

FOREIGN PATENT DOCUMENTS

JP 9-314709 12/1997
JP 11-324224 11/1999

* cited by examiner

*Primary Examiner*—A. Vanatta
*Assistant Examiner*—Robert Muromoto, Jr.
(74) *Attorney, Agent, or Firm*—Kenyon & Kenyon

(57) ABSTRACT

A cylindrical net body using helical wire members that can be easily assembled and disassembled at a working site. The invention provides also a cylindrical net body using helical wire members that have high tenacity and high durability and yet can reduce the weight. Wire members having a predetermined outer diameter are wound in predetermined lead and predetermined pitch to provide helical wire members in such a fashion that a diameter of a helix is about twice the outer diameter of the wire members, crests and troughs have substantially a similar shape, and each trough is positioned outside the center of the helix. The helical wire members are wound into a coil shape to form transverse helical wire members. Longitudinal helical wire members formed of the helical wire members are united and fixed side by side with the transverse helical wire members, with predetermined gaps, to form a cylindrical net body.

18 Claims, 11 Drawing Sheets

NET BODY USING HELICAL WIRE MEMBERS

TECHNICAL FIELD

This invention relates to a planar or cylindrical net body using helical wire members.

BACKGROUND ART

In biological tissues of living bodies such as bone, tendon and blood vessel, collagen filaments having a helical structure with flexibility constitute fibers for crests and troughs are united side by side. The biological tissue dispersedly supports an external force applied thereto on the helical slope of the collagen filaments united side by side, and exhibits high toughness. When some of the collagen filaments are damaged, the biological tissue exchanges the damaged collagen filaments with new ones, according to the metabolism, so as to maintain the tissue.

The inventor of this invention filed Japanese Unexamined Patent Publication (Kokai) Nos. 8-290501, 8-291587 and 9-314709 on the basis of the helical structure of the collagen filaments, in particular. The technologies described in these Laid-Open Patent Publications propose building structures such as a post member, a wall member and a sheet member all of which combine helical wire members, can provide high toughness and can easily be repaired when a part of the structure is damaged. Japanese Unexamined Patent Publication Nos. 8-290501 and 8-291587 describe a helical structure obtained by uniting helical bodies, with their crests and troughs side by side, wherein each helical body is formed by winding, in predetermined lead and predetermined pitch, wire members having a predetermined diameter into a shape such that a diameter of a helix is about twice the wire diameter, the crests and the troughs oppose one another or have substantially a similar shape, and the troughs are positioned outside from the center of the helix, or a helical structure wherein the helical bodies are wound in the same winding direction or are wound alternately. In the helical structure described above, Japanese Unexamined Patent Publication (Kokai) No, 9-314709 proposes a helical structure by combining, vertically and transversely, helical wire members for a helical structure and forming a planar mesh, wherein the helical wire members can strongly fix or release the uniting state of the helical bodies, can exhibit a predetermined motion in accordance with an environmental change and can keep the size of the mesh constant.

DISCLOSURE OF THE INVENTION

It is an object of the present invention to provide a net body that can be assembled and disassembled easily and quickly at a working site by using the helical wire members having the features described above. It is another object of the present invention to provide a net body having high toughness and excellent impact resistance by using the helical wire members. It is a further object of the present invention to provide a net body having high tenacity and high durability and yet capable of reducing the weight, by using the helical wire members.

The first invention of this invention provides a net body using helical wire members, comprising a large number of transverse helical wire members formed of first helical wire members obtained by helically winding, in predetermined lead and predetermined pitch, wire materials having a predetermined outer diameter in such a fashion that a diameter of a helix is about twice the outer diameter of the wire materials, crests and troughs of the wire materials have substantially a similar shape and each of the troughs is positioned outside the center of the helix, the transverse helical wires being arranged with predetermined gaps; and longitudinal helical wire members formed of second helical wire members having a different winding direction from that of the first helical wire members, and are combined with the transverse helical wire members in such a fashion that respective crests and troughs engage with one another so as to permit deformation of the net body.

The second invention of this invention provides a net body using helical wire members, comprising a large number of transverse helical wire members formed by curving at a predetermined radius of curvature helical wire members produced by helically winding, in predetermined lead and predetermined pitch, helical wire materials having a predetermined outer diameter in such a fashion that a diameter of a helix is about twice the outer diameter of the wire materials, crests and troughs of the wire materials have substantially a similar shape and each of the troughs is positioned outside the center of the helix; and longitudinal helical wire members is formed of helical wire members, and are combined with the transverse helical wire members in such a fashion that respective crests and troughs engage with one another so as to provide net body comprising a curve sheet.

BEST MODE FOR CARRYING OUT THE INVENTION

Hereinafter, embodiments of the present invention will be explained with reference to the drawings (showing schematically a helical wire member in each of FIGS. 2 and 3).

Embodiment 1

Figure 1:
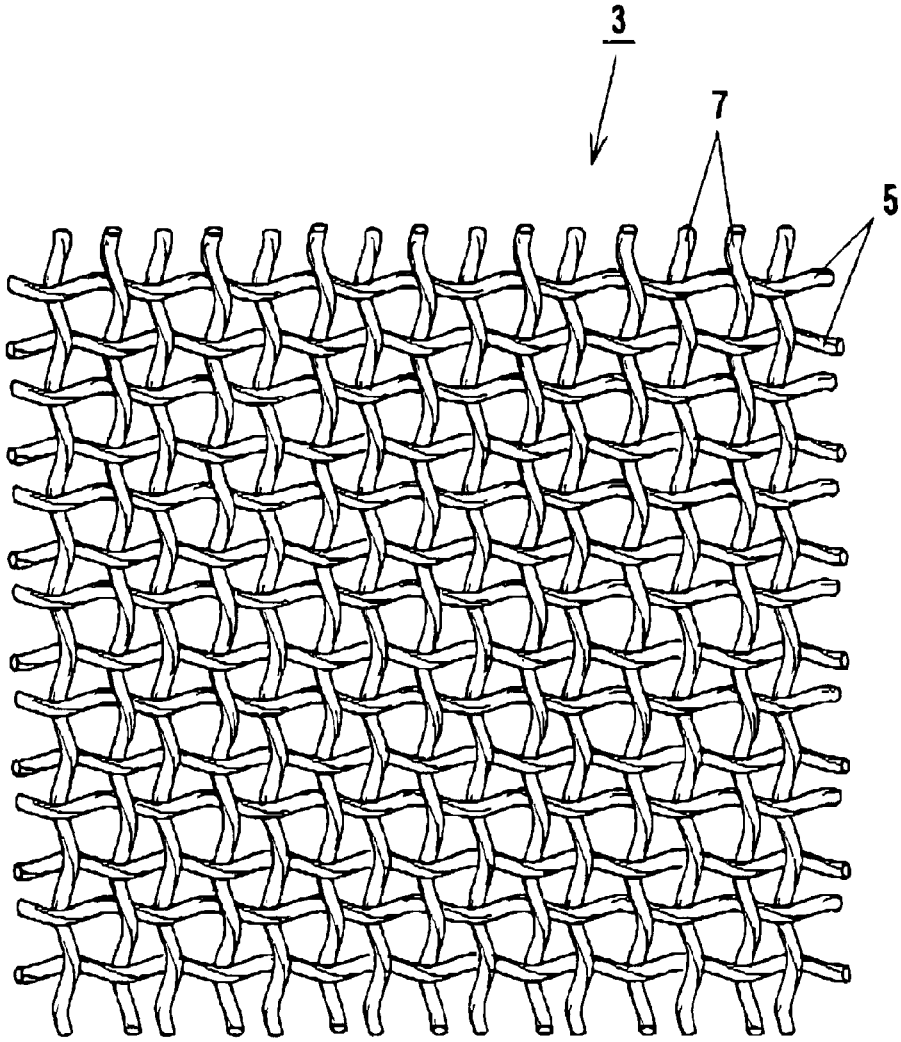
FIG. 1 is a schematic perspective view of a net body according to the present invention.
Figure 2:
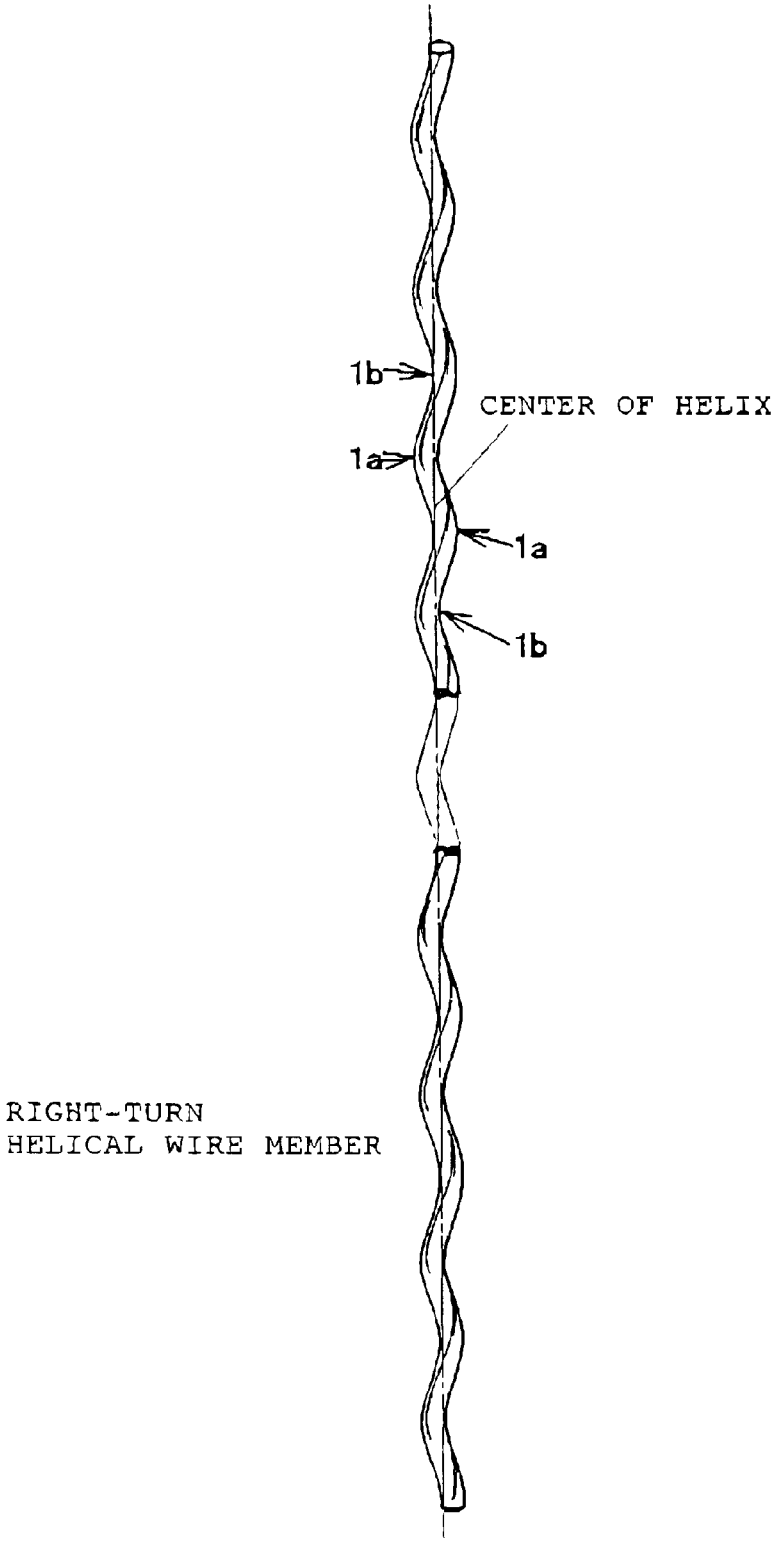
FIG. 2 is a perspective view of a helical wire member according to the present invention.
Figure 3:
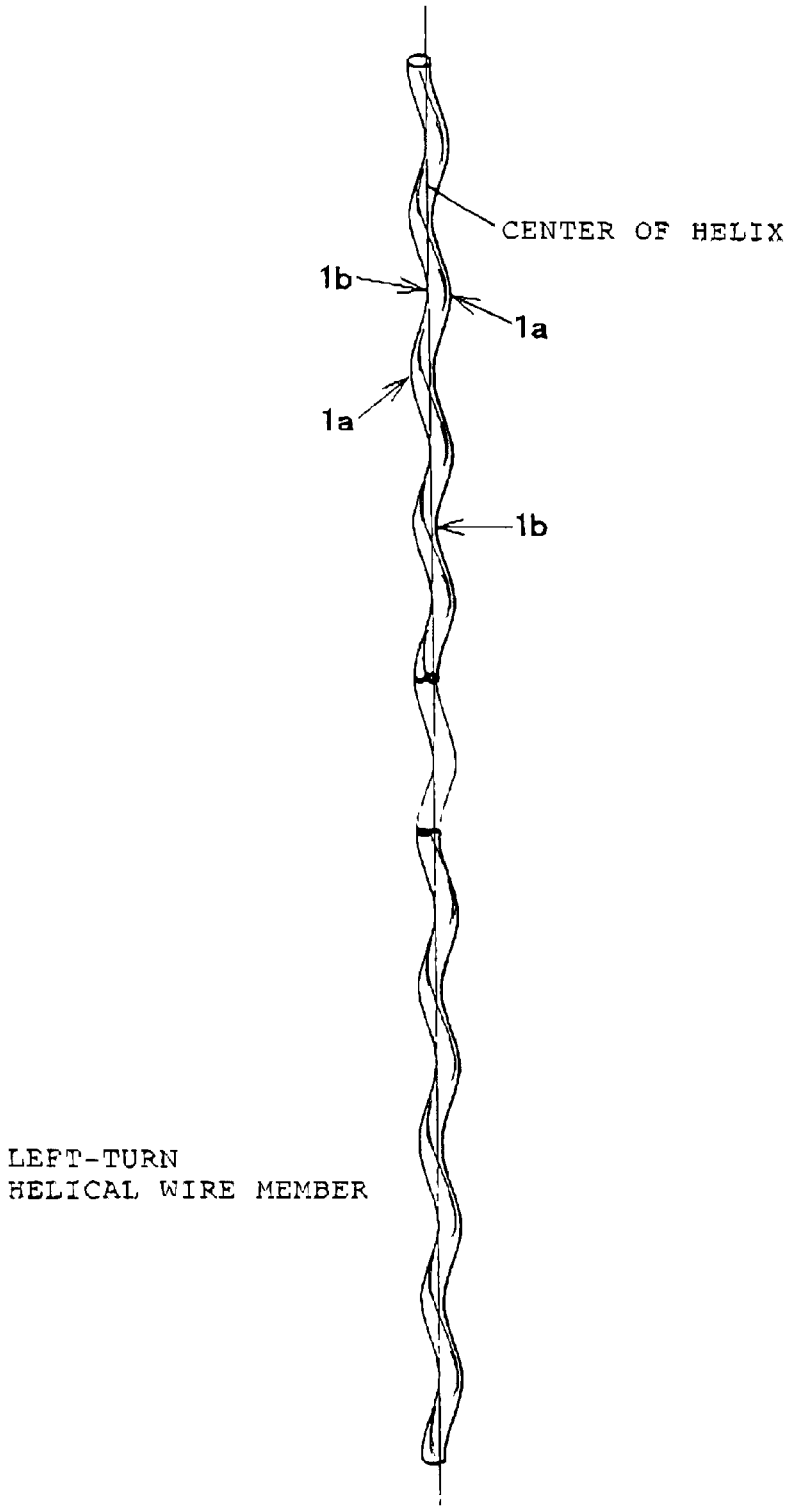
FIG. 3 is a perspective view showing a helical wire member having a different helical winding direction from that of FIG. 2.

FIGS. 1 to 4 show a net body 3 according to claim 1. A helical wire member 1 is made of various wire materials such as metal, plastic, ceramic (inclusive of glass), concrete, wood, and carbon fiber. The diameter of a helix is about twice the diameter of the wire material. The wire member 1 is wound in predetermined lead and predetermined pitch in such a fashion that crests 1*a* of the helical wire member 1 and its troughs 1*b* have substantially a similar shape, and the troughs are positioned in conformity with, or outside of, the center of the helix. In this winding structure, the helical wire members 1 are wound so that the space at the helical center is discontinuous in the axial direction, that is, the space does not exist when viewed from the axial direction. FIG. 2 shows the helical wire member 1 that has a right-turn helical structure extending upward in the axial direction, and FIG. 3 shows the helical wire member 1 that has a left-turn helical structure extending upward in the axial direction.

The net body 3 is produced, for example, by combining transverse helical wire members 5 consisting of the right-turn helical wire members 1 and the longitudinal helical wire members 7 consisting of the left-turn helical wire members 1 into a planar shape in such a fashion that their troughs 1*b* engage with one another. The engaging method is as follows. While a plurality of transverse helical wire members 5 are arranged in such a fashion that their crests 1*a* and troughs 1*b* appear alternately with predetermined gap, the longitudinal helical wire members 7 are turned in the helical direction, and the crests 1*a* are allowed to engage with the troughs 1*b* to form the net body 3. Needless to say, the helical direction of both transverse helical wire member 5 and longitudinal helical wire member 7 may have a relation opposite to the relation described above.

Figure 4:
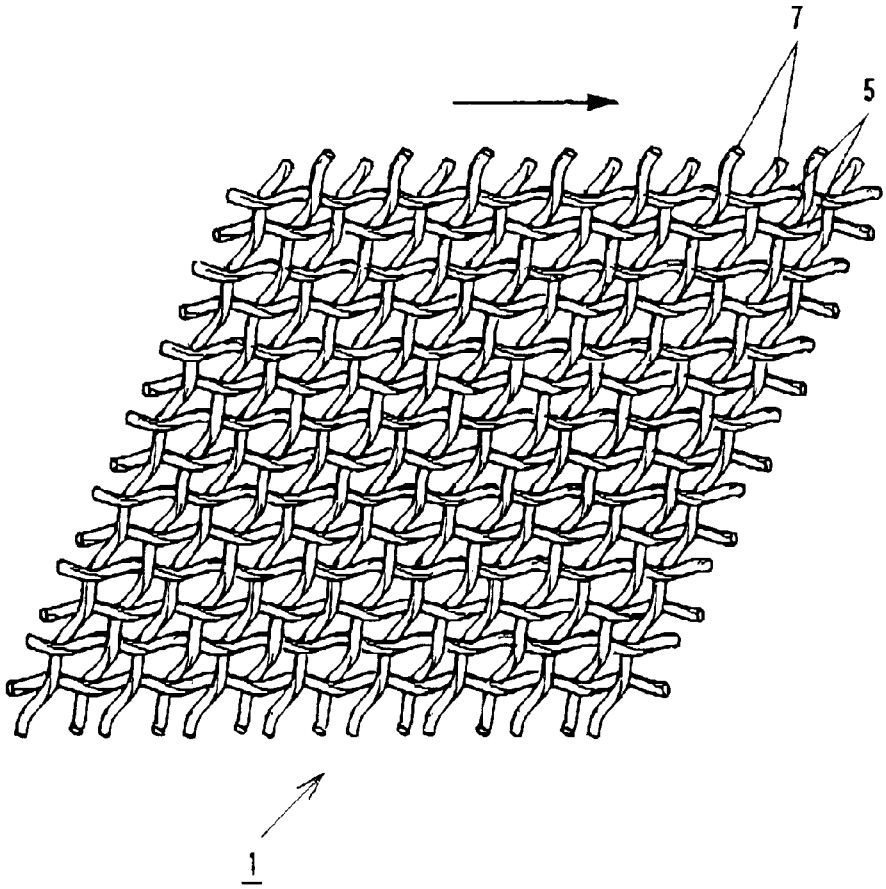
FIG. 4 is an explanatory view showing a deformation state of the net body according to the present invention.

As shown in FIG. 1, the net body 3 having the construction described above can keep constant the size of each of every other stitch positioned in the longitudinal and horizontal directions in the relation in which the axis of the transverse helical wire member 5 crosses the axis of the longitudinal helical wire member 7. When each longitudinal helical wire member 7 is inclined, the area of each stitch can be reduced as shown in FIG. 4. Therefore, the net body 3 can be utilized as a classifier that allows the passage of only those matters which are smaller than the mesh or as a catcher that catches those matters which are caught inside the meshes when the stitch contracts.

Figure 5:
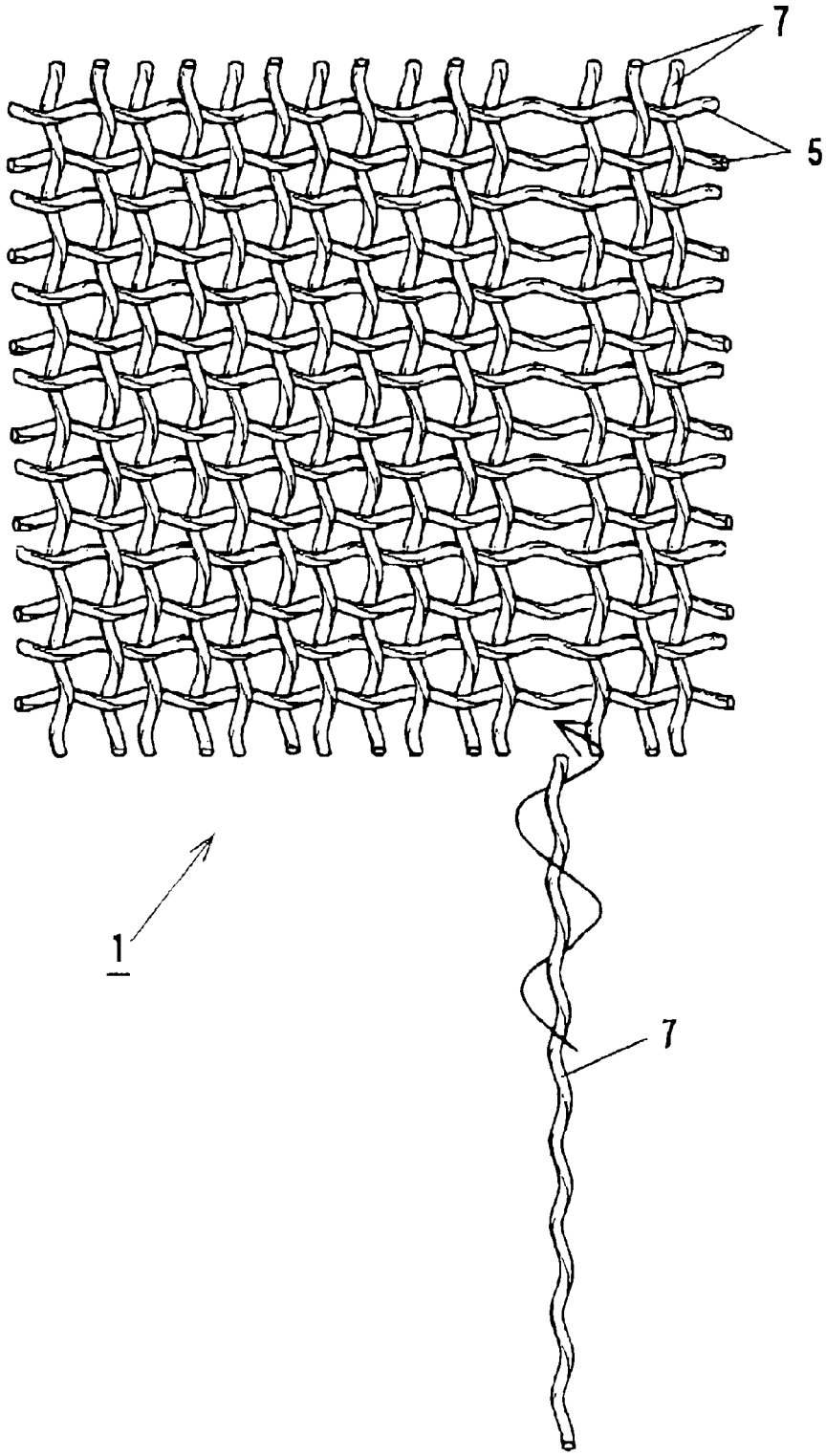
FIG. 5 is an explanatory view useful for explaining a repair state of a net body according to the present invention.

When a part of the transverse helical wire member 5 or the longitudinal helical wire member 7 is damaged, the damaged longitudinal helical member 7 is turned in a direction opposite to the engaging direction as shown in FIG. 5 (that shows the case where the longitudinal helical wire member 7 is damaged) and is removed, and the new helical wire member 7 is then rotated in the helical direction and is engaged. In this way, the damaged longitudinal helical wire member 7 can be exchanged and repaired.

Embodiment 2

Figure 6:
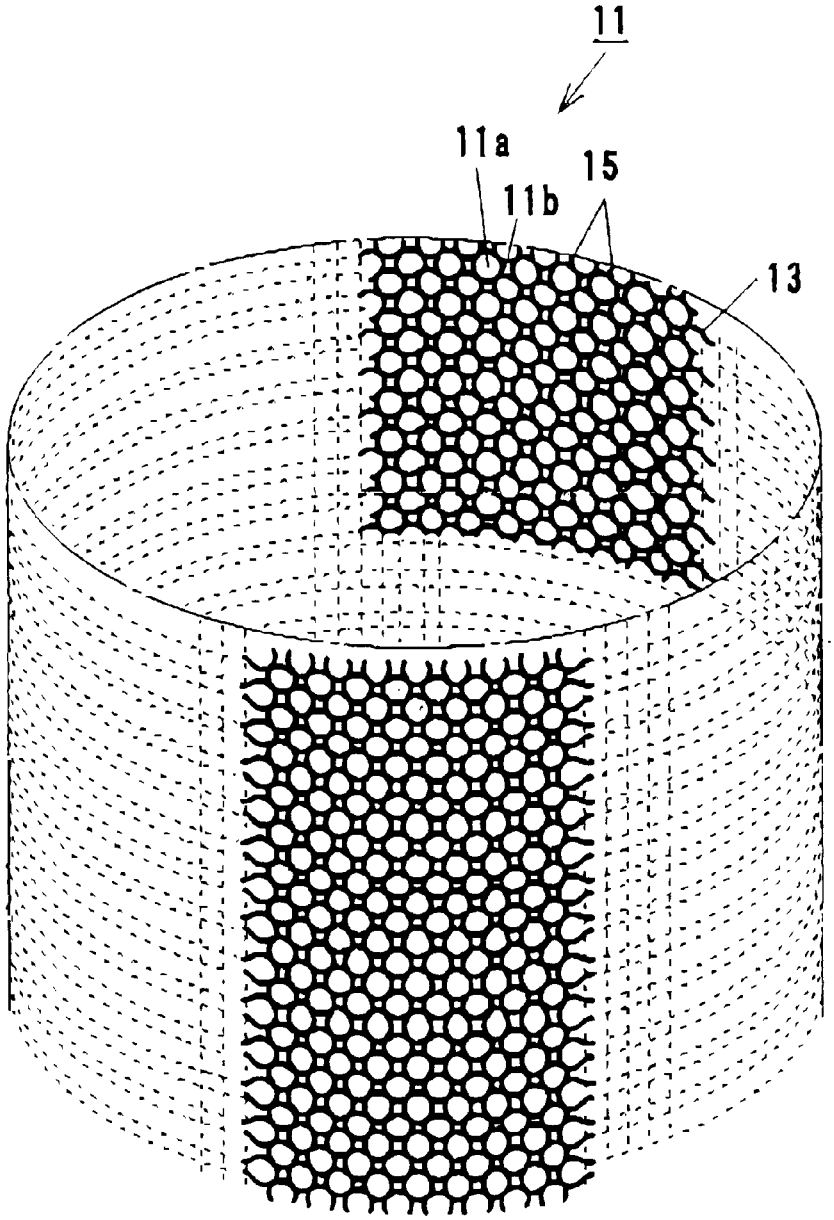
FIG. 6 is a schematic perspective view of a cylindrical net body according to Embodiment 2 of the present invention.

FIG. 6 shows a cylindrical net body according to claim 2. The transverse helical wire member 13 of the cylindrical net body 11 has a right-turn structure, for example, and is produced by winding continuous helical wire materials 1 having a length corresponding to the outer diameter of the cylindrical net body 11 to be formed and its axial length into a coil shape having a predetermined outer diameter and spaced apart by predetermined gap in the axial direction. It is preferred that in the transverse helical wire members 13 thus wound into the coil shape, the crests 1*a* and the troughs 1*b* are alternately arranged in the axial direction of the peripheral surface.

While being rotated in the helical direction, the longitudinal helical wire members 15 having the same helical direction as the transverse helical wire members 13 are combined with the latter to form the cylindrical net body 11 in such a fashion that the crests 1*a* and the troughs 1*b* engage with one another. At this time, the meshes of the cylindrical net body 11 include large meshes 11*a* formed by the adjacent troughs 1*b* and the small meshes 11*b* formed by the opposing troughs 1*a*.

In the cylindrical mesh body 11 assembled as described above, the transverse helical wire members 13 and the longitudinal wire members 15 engage with one another at their crests 1*a* and troughs 1*b*. Therefore, when any external force acts from the side on the cylindrical mesh body 11, this external force is dispersedly borne by the slope extending from the troughs 1*b* to the crests 1*a* of the transverse helical wire members 13 and the longitudinal helical wire members 15 engaging with one another, thereby making it possible to prevent deformation of the cylindrical mesh body 11 and to keep its cylindrical shape.

Figure 7:
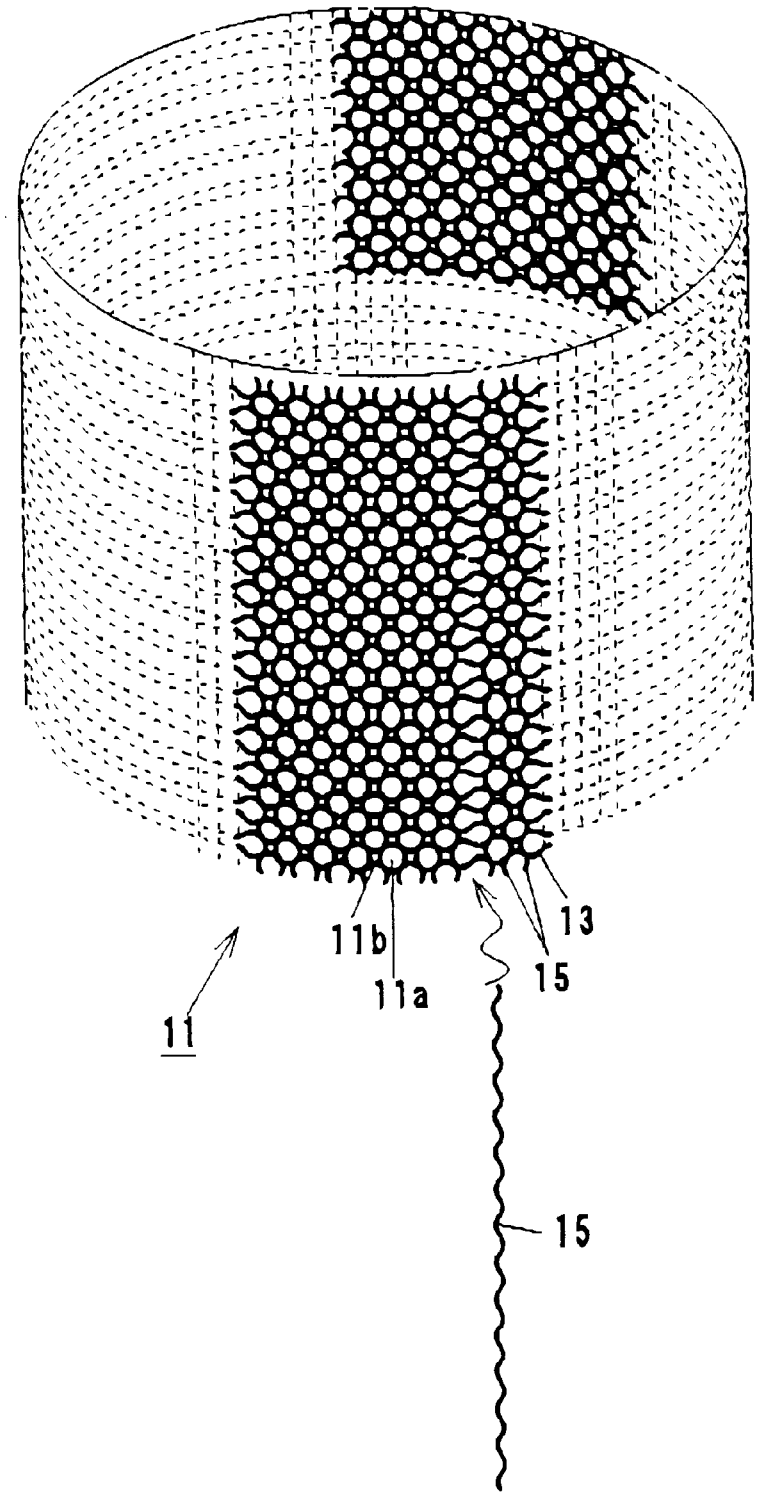
FIG. 7 is an explanatory view useful for explaining a repair state of a cylindrical net body according to the present invention.

When a part of the longitudinal helical wire members 15 among the transverse and longitudinal helical wire members 13 and 15 constituting the cylindrical net body 11 is damaged, the damaged longitudinal helical wire member 15 is rotated in the direction opposite to the direction used for assembly to release the engagement, and it is removed as shown in FIG. 7. Thereafter, the new longitudinal helical wire member 15 is engaged while being rotated, and the repair is made. In this way, the cylindrical net body 11 can be easily repaired and its durability can be improved.

Incidentally, the transverse helical wire member 13 is preferably under the winding state where the crests 1*a* and the troughs 1*b* are alternately deviated from one another. However, as the crests 1*a* and the troughs 1*b* of the helical wire member 1 itself are alternately formed in a predetermined pitch, these crests and troughs 1*a*, 1*b* may be inclined at a suitable angle in the vertical direction and may be alternately deviated from one another in the vertical direction. In this case, the longitudinal helical wire members 15 are engaged with the transverse helical wire members 13 under a certain tilt state in the axial direction to form the cylindrical net body 11.

Figure 8:
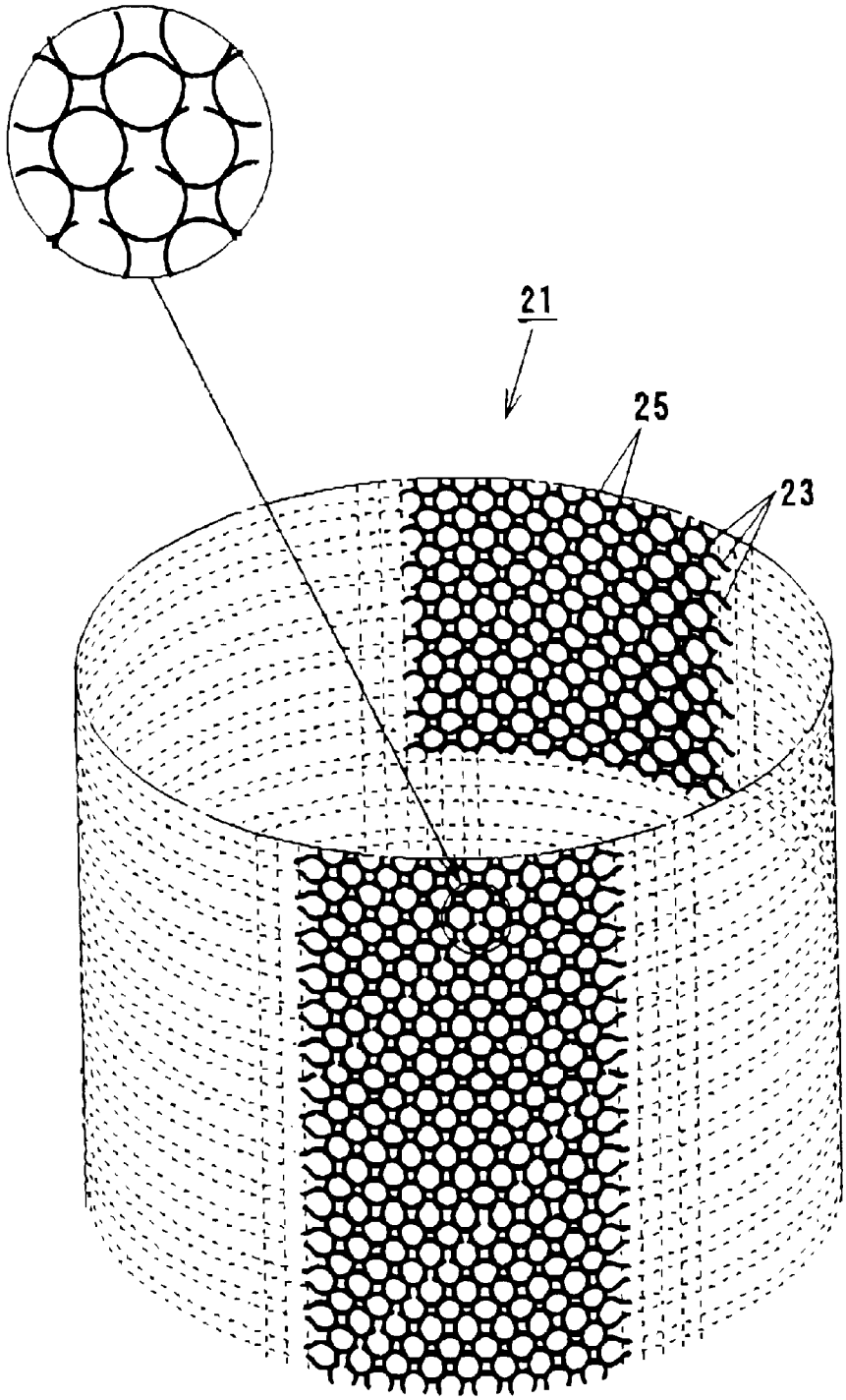
FIG. 8 is schematic perspective view showing a modified example of Embodiment 2 according to the present invention.

In this embodiment, the longitudinal helical wire members 15 are combined with the transverse helical wire members 13 formed by winding the continuous helical wire materials 1 having a length corresponding to the outer diameter of the cylindrical mesh body 11 and the axial length into the coil shape in such a fashion that the crests 1*a* and the troughs 1*b* engage with one another to form the cylindrical mesh body 11. As shown in FIG. 8, however, the cylindrical net body 21 may be formed by arranging a large number of ring-shaped horizontal helical wire members 23 having a length equal at least to the outer diameter of the cylindrical net body 21 with gaps among them in the axial direction, arranging them so that the crests and the troughs are alternately positioned in the peripheral surface axial direction, and combining these transverse helical wire members 23 with the longitudinal helical wire members 25 in such a fashion that the crests and the troughs engage with one another.

In the explanation given above, the net body is formed into the cylindrical shape. However, the cylindrical body of the invention is not limited to the cylindrical shape but may take various shapes having therein a hollow such as a square cylinder, a truncated cone and a truncated pyramid.

Embodiment 3

Figure 9:
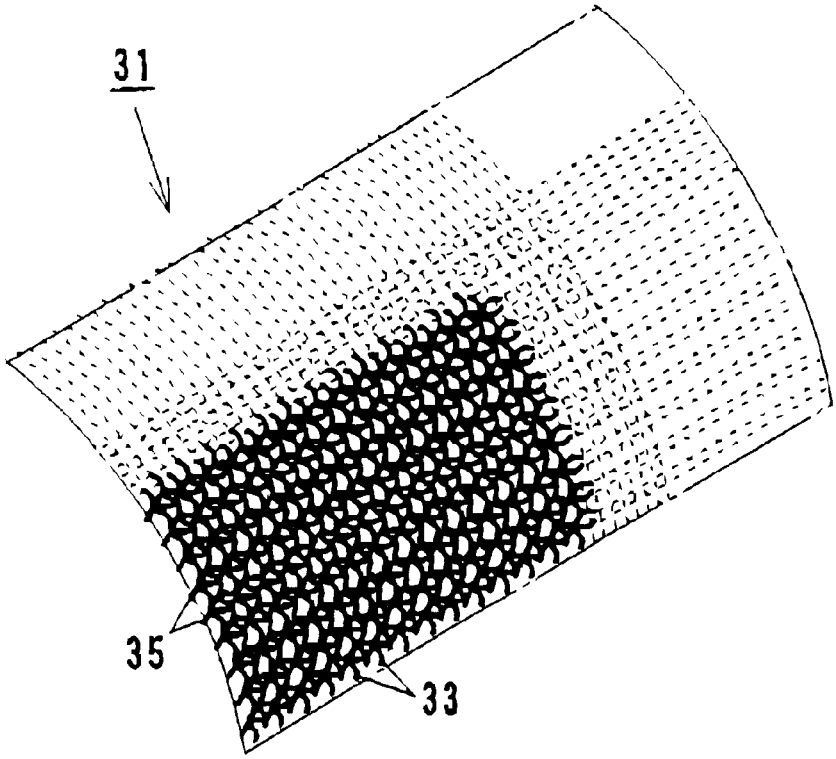
FIG. 9 is a schematic perspective view of a curved panel according to Embodiment 2 of the present invention.
Figure 10:
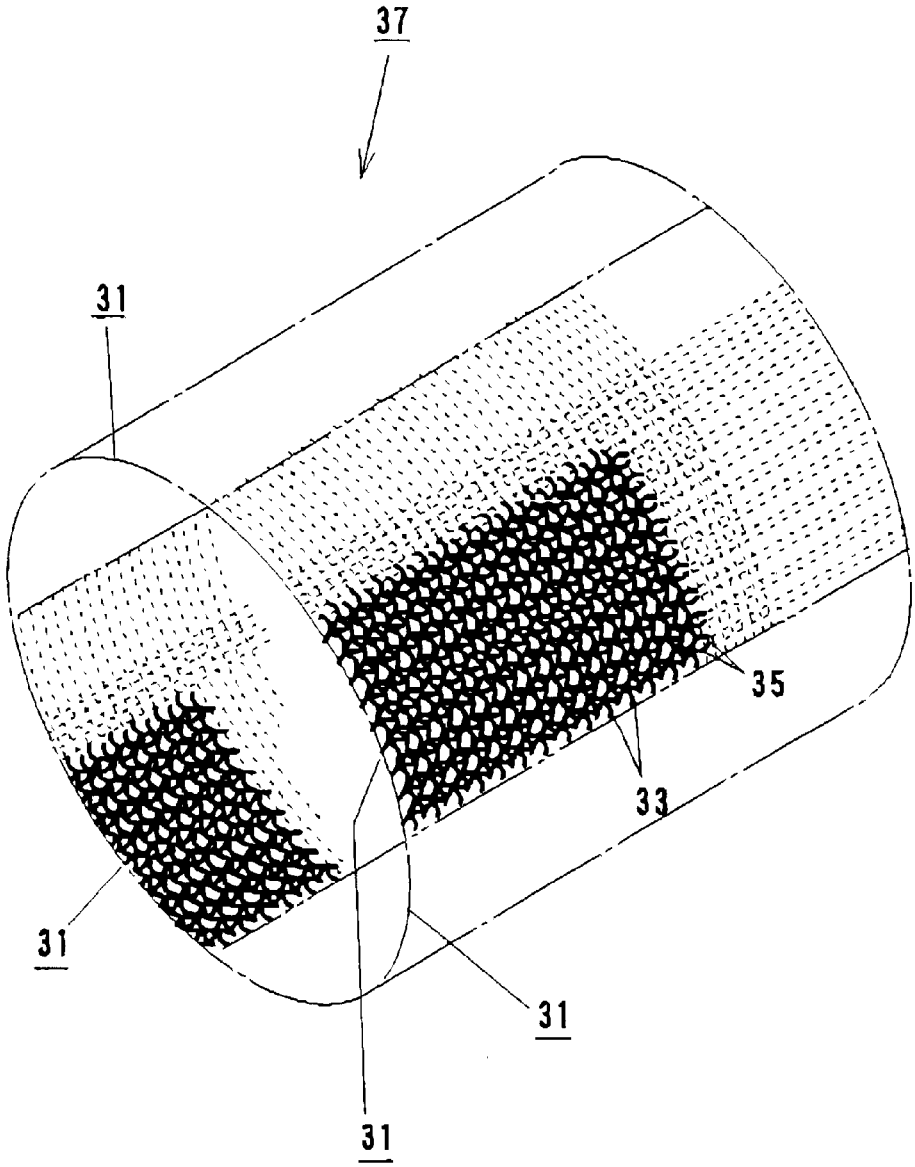
FIG. 10 is a schematic perspective view showing an example of a cylindrical net body produced from a curved panel according to the present invention.
Figure 11:
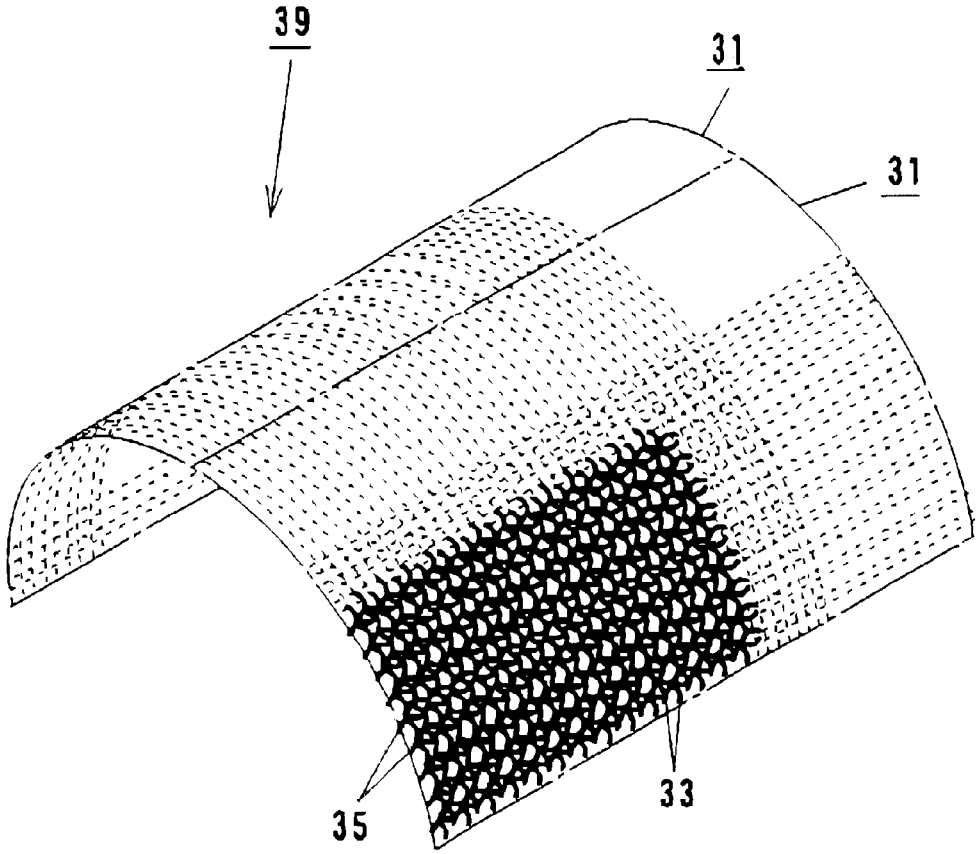
FIG. 11 is a schematic perspective view showing an example of an arc-shaped net body produced from a curved panel according to the present invention.

A curved panel 31 shown in FIGS. 9 to 11 comprises a large number of transverse helical wire members 33 bent at a radius of curvature corresponding substantially to the curve of a cylinder or arc to be formed, spaced apart by a predetermined gap from one another and arranged in deviation in such a fashion that the crests 1*a* oppose the troughs 1*b* at at least the end portions thereof, and the longitudinal helical wire members 35 wound in the same winding direction as the transverse helical wire members 33 in such a fashion that the crests 1*a* and the troughs 1*b* engage with one another with respect to each transverse helical wire member 33.

A plurality of curved panels 31 is arranged in such a fashion that the end portions of the transverse helical wire members 33 come adjacent to one another. After the curved panels 31 are thus combined with one another, the longitudinal helical wire members 35 are engaged and interconnected with the interconnecting positions of the curved panels 31, and the cylindrical net body 37 shown in FIG. 10 or the arc-shaped net body 39 shown in FIG. 11 is formed.

In other words, every other of a large number of transverse helical wire members 33 arranged in the curved panel 31 is rotated so that the end portions of the transverse helical wire members protrude from one of the end portions of the carved panel body 31. In consequence, a recess corresponding to each protruding width is formed in every other transverse helical wire member 33 at the other end of the curved panel body 3. After the end portions of the protruding transverse helical wire members of the curved panel body 31 are fitted into the recesses at the other end of the adjacent curved panel body 31, the longitudinal helical wire member 35 is rotated at this interconnection position so that the crests 1*a* and the troughs 1*b* are engaged with the crests 1*a* and the troughs 1*b* of the adjacent transverse helical wire member 33. As a result, the cylindrical net body 37 shown in FIG. 10 or the arc-shaped net body 39 shown in FIG. 11 is formed.

In this interconnecting method, a large number of transverse helical wire members 33 may be arranged when forming the curved panel body 31 in such a fashion that one of the end portions of a part of the transverse helical wire members 33 protrudes by a predetermined width to the other transverse helical wire members 33.

In Embodiments 2 and 3 described above, the transverse helical wire members and the longitudinal helical wire members are combined to form the cylindrical net body or the curved panel body so that their crests and troughs engage with one another. When an external force acts on these cylindrical net body and curve panel body, the crests and the troughs engaging with one another restrict the positioning error and suppress deformation. When transverse and longitudinal wire members having mutually different helical winding directions are used, the cylindrical net body and the curved panel body can be easily deformed so that their meshes expand and contract.

The net body according to the present invention can be used for the following applications.

1) The net body has the following features when it is used as a pole material.

The net body can be easily assembled and disassembled at a working site and can drastically reduce the working time.

The cylindrical net body and the curved panel body have themselves a large number of meshes formed by the transverse helical wire members and the longitudinal helical wire members. Therefore, they can pass a fluid and can avoid damage resulting from wind pressure and water pressure.

In the case of the cylindrical net body and the curve panel body formed by using the transverse helical wire members and the longitudinal helical wire members having different winding directions, in particular, the meshes can be easily deformed and allowed to expand and contract, and damage resulting from wind pressure, etc, can be effectively avoided. In the case of the pole material used for an application such as a pole, for example, deformation due to the wind pressure, etc, can be effectively prevented when the transverse helical wire members and the longitudinal helical wire members having the same winding direction are combined to form the cylindrical net body and the curved panel body.

2) The net body has the following features when it is used for a mold.

When the transverse helical wire members and the longitudinal helical wire members are combined, it is possible to form a cylindrical net body having a predetermined diameter of a cylinder as a mold. The mold can be assembled easily and quickly without requiring a high level of skill.

3) When the net body is disposed between fixed bodies and is used as a pipe material for accommodating therein various cables, the cylindrical net body or the curved panel body produced by combining the transverse helical wire members and the longitudinal helical wire members having different helical winding directions is employed, and has the following features. When the cylindrical net body or the curve material is used as the pipe material, it has the same feature as that of the pole material described above. In addition, even when the fixed bodies undergo the positioning error due to the earthquake, or the like, the pipe material can easily undergo deformation while keeping the hollow portion substantially constant, and can safely keep the cable, etc, stored therein.

4) The curve panel body according to Embodiment 3 can be used as a reinforcing frame for preventing fall-off of concrete wall materials of a tunnel, etc. In this application, a plurality of kinds of curved panel bodies corresponding to the curve surface of the concrete wall materials are assembled at site and are interconnected to one another into the arc shape so as to cover the wall surface and to prevent fall-off of concrete chips resulting from cracks.

INDUSTRIAL APPLICABILITY

The net body according to the present invention can be assembled and disassembled easily and quickly at a working site. It has high tenacity and high durability. Further, although it has high tenacity and high durability, the net body can be made light in weight.

What is claimed is:

1. A net body using helical wire members, comprising:

a large number of transverse helical wire members formed of first helical wire members obtained by helically winding, in a predetermined lead and predetermined pitch, helical wire materials having a predetermined outer diameter in such a fashion that a diameter of a helix is about twice the outer diameter of said wire materials, crests and troughs of said wire materials have substantially a similar shape and each of said troughs is positioned outside the center of the helix, said transverse helical wires being arranged with predetermined gaps; and longitudinal helical wire members formed of second helical wire members having a different winding direction from that of said first helical wire members, and combined with said transverse helical wire members in such a fashion that respective crests and troughs engage with one another so as to permit deformation of said net body.

2. A net body using helical wire members, comprising:

a large number of transverse helical wire members formed by curving, at a predetermined radius of curvature, helical wire members produced by helically winding, in a predetermined lead and predetermined pitch, helical wire materials having a predetermined outer diameter in such a fashion that a diameter of a helix is about twice the outer diameter of said wire materials, crests and troughs of said wire materials have substantially a similar shape and each of said troughs is positioned outside the center of the helix; and longitudinal helical wire members formed of helical wire members, and combined with said transverse helical wire members in such a fashion that respective crests and troughs engage with one another so as to provide a curve sheet.

3. A net body using helical wire members according to claim 2, wherein a plurality of curve sheets are combined into a cylindrical shape.

4. A net body using helical wire members according to claim 2, wherein a plurality of curve sheets are combined into an arc shape.

5. A net body using helical wire members, comprising:

transverse helical wire members formed of elongated helical wire members obtained by helically winding, in a predetermined lead and predetermined pitch and into a coil shape, wire materials having a predetermined outer diameter in such a fashion that a diameter of a helix is about twice the outer diameter of said wire materials, crests and troughs of said wire materials have substantially a similar shape and each of said troughs is positioned outside the center of the helix, said helical wires being wound into a coil shape having a predetermined outer diameter and predetermined gaps in an axial direction; and longitudinal helical wire members formed of helical wire members, and combined with said transverse helical wire members in such a fashion that respective crests and troughs engage with one another so as to provide a cylindrical shape.

6. A net body using helical wire members, comprising:

a large number of transverse helical wire members formed by winding, annularly into at least a predetermined outer diameter, helical wire members obtained by helically winding, in predetermined lead and predetermined pitch, helical wire materials having a predetermined outer diameter in such a fashion that a diameter of a helix is about twice the outer diameter of said wire materials, crests and troughs of said wire materials have substantially a similar shape and each of said troughs is positioned outside the center of the helix, said transverse helical wire members being arranged in such a fashion that end portions thereof are deviated from one another with a predetermined width around the axes thereof; and longitudinal helical wire members are combined with said transverse helical wire members into a cylindrical shape in such a fashion that respective crests and troughs engage with one another.

7. A net body using helical wire members according to claim 3, wherein said net body is shaped into a cylindrical shape.

8. A net body using helical wire members according to claim 5, wherein said net body is shaped into a cylindrical shape.

9. A net body using helical wire members according to claim 6, wherein said net body is shaped into a cylindrical shape.

10. A net body using helical wire members according to claim 3, wherein said net body is shaped into prismatic shape.

11. A net body using helical wire members according to claim 5, wherein said net body is shaped into prismatic shape.

12. A net body using helical wire members according to claim 6, wherein said net body is shaped into prismatic shape.

13. A net body using helical wire members according to claim 2, wherein said transverse helical wire member and said longitudinal helical wire member use helical wire materials having different helical winding directions so as to permit deformation of said net body.

14. A net body using helical wire members according to claim 5, wherein said transverse helical wire member and said longitudinal helical wire member use helical wire materials having different helical winding directions so as to permit deformation of said net body.

15. A net body using helical wire members according to claim 6, wherein said transverse helical wire member and said longitudinal helical wire member use helical wire materials having different helical winding directions so as to permit deformation of said net body.

16. A net body using helical wire members according to claim 2, wherein said transverse helical wire member and said longitudinal helical wire member use helical wire materials having the same helical winding direction so as not to permit deformation of said net body.

17. A net body using helical wire members according to claim 5, wherein said transverse helical wire member and said longitudinal helical wire member use helical wire materials having the same helical winding direction so as not to permit deformation of said net body.

18. A net body using helical wire members according to claim 6, wherein said transverse helical wire member and said longitudinal helical wire member use helical wire materials having the same helical winding direction so as not to permit deformation of said net body.

* * * * *